US006766923B1

(12) United States Patent
Huang

(10) Patent No.: US 6,766,923 B1
(45) Date of Patent: Jul. 27, 2004

(54) TRIGGERING MECHANISM OF A GLUE GUN

(75) Inventor: Chi-Chuan Huang, Chang Hua Hsien (TW)

(73) Assignee: Kai Shyun Enterprise Co., Ltd., Chang Hua Hsien (TW)

( * ) Notice: Subject to any disclaimer, the term of this patent is extended or adjusted under 35 U.S.C. 154(b) by 0 days.

(21) Appl. No.: 10/640,760

(22) Filed: Aug. 15, 2003

(51) Int. Cl.[7] ..... B65D 88/54

(52) U.S. Cl. ..... 222/327; 222/391

(58) Field of Search ..... 222/327, 391

(56) References Cited

U.S. PATENT DOCUMENTS 6,089,412 A * 7/2000 Snell et al. ..... 222/391
6,412,667 B1 * 7/2002 Huang ..... 222/327

* cited by examiner

*Primary Examiner*—Philippe Derakshani
(74) *Attorney, Agent, or Firm*—Charles E. Baxley

(57) ABSTRACT

A glue gun includes a triggering mechanism which is formed of a push piece, an action piece, a control lever, a retaining piece, and a release knob. As the action piece is activated by the control lever, and the push piece is actuated by the action piece to push an activation rod to move toward a glue container. When the release knob is activated, the activation rod is released by the retaining piece so as to be forced by the spring force of a recovery spring to move away from the glue container.

2 Claims, 3 Drawing Sheets

TRIGGERING MECHANISM OF A GLUE GUN

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a glue gun, and more particularly to an activating mechanism of the glue gun.

BACKGROUND OF THE INVENTION

The conventional glue gun comprises a triggering mechanism which is complicated in construction and is susceptible to failure. In addition, the triggering mechanism comprises a recovery spring which is not shielded and is therefore vulnerable to rusting and being impacted by a foreign object.

BRIEF SUMMARY OF THE INVENTION

The primary objective of the present invention is to provide a glue gun with a triggering mechanism simple in construction and operation.

The features and the advantages of the present invention will be readily understood upon a thoughtful deliberation of the following detailed description of the present invention with reference to the accompanying drawings.

DETAILED DESCRIPTION OF THE INVENTION

Figure 1:
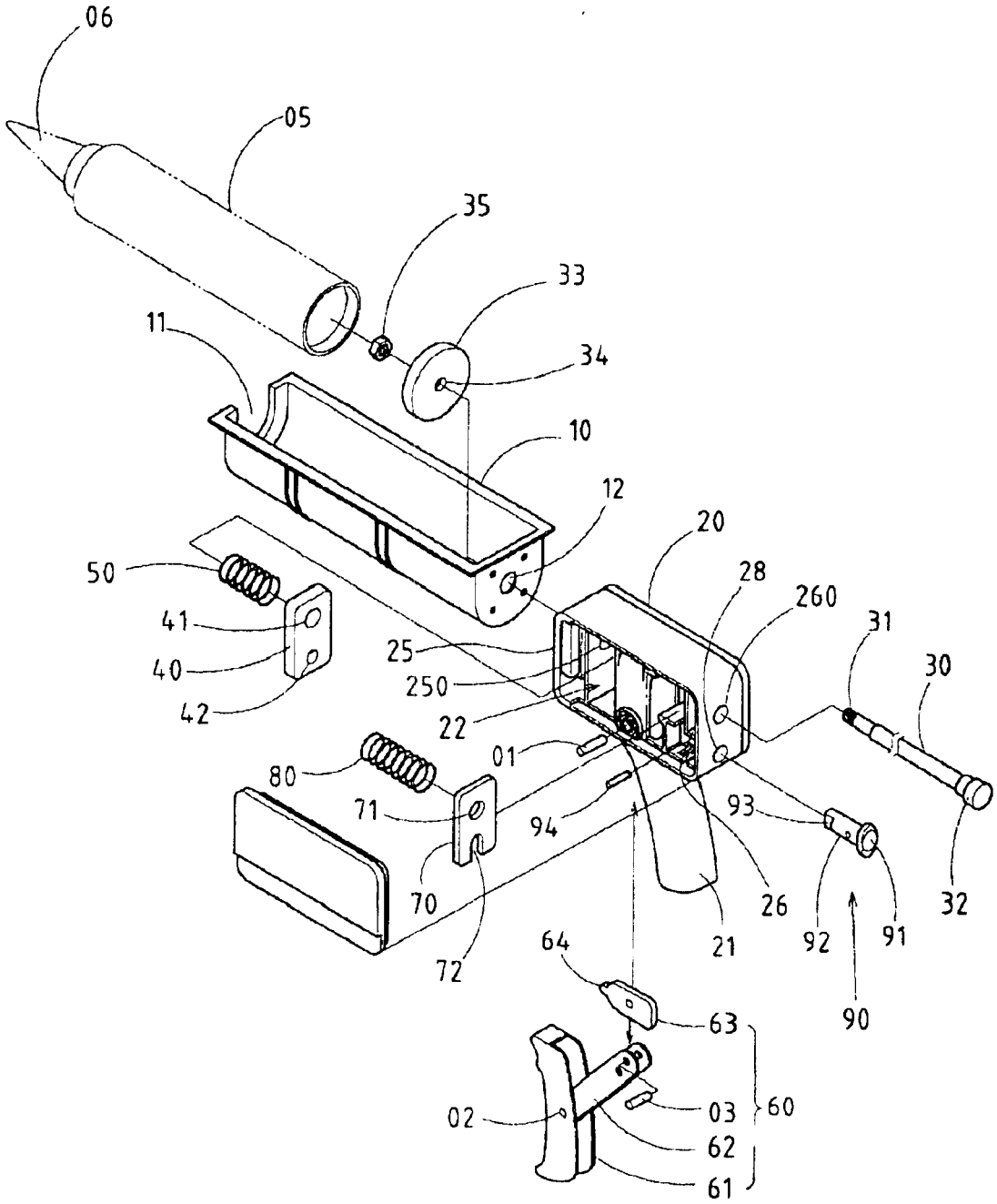
FIG. 1 shows an exploded perspective view of the present invention.
Figure 2:
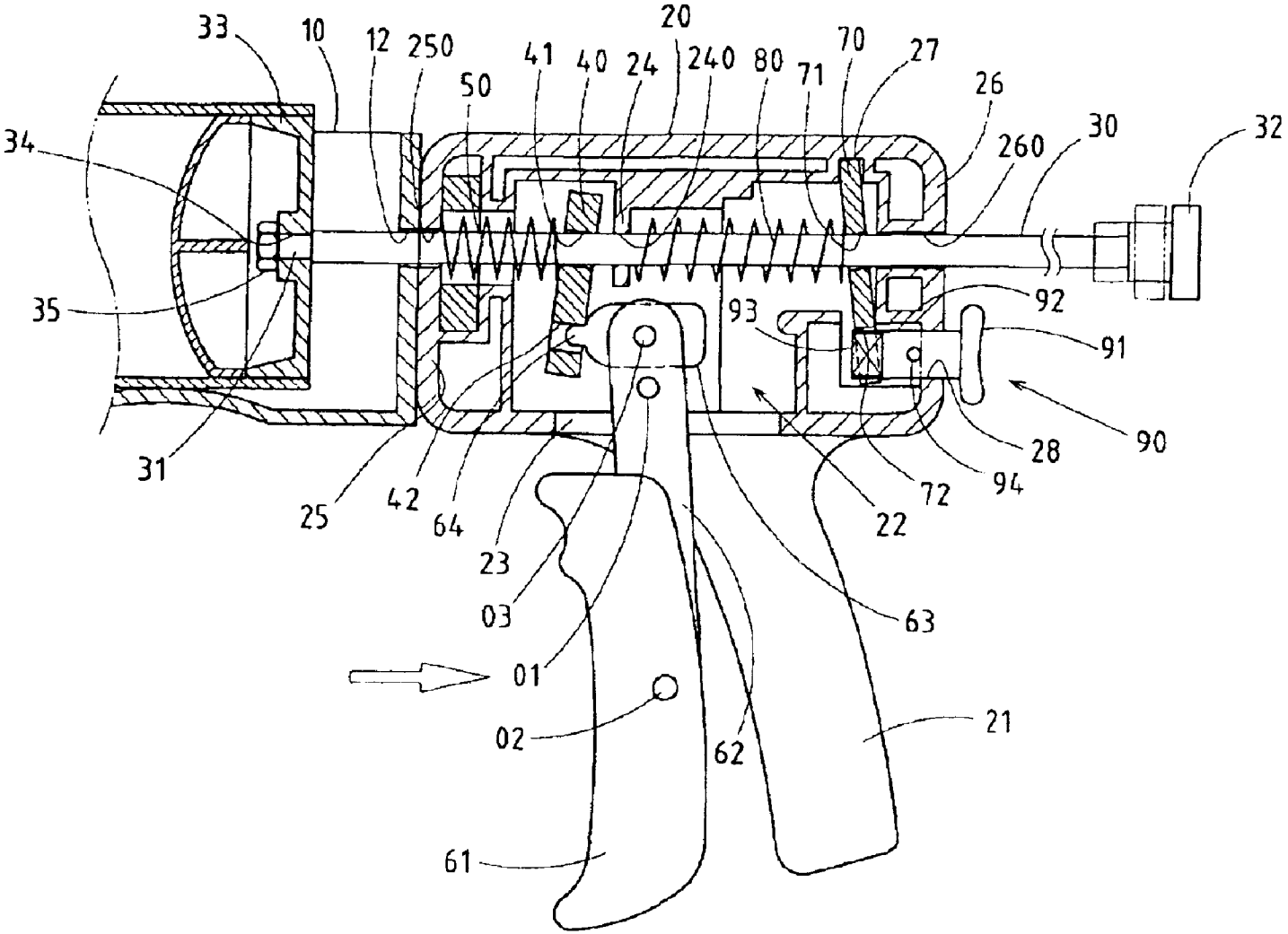
FIG. 2 shows a sectional schematic view of the present invention with the control lever being activated.
Figure 3:
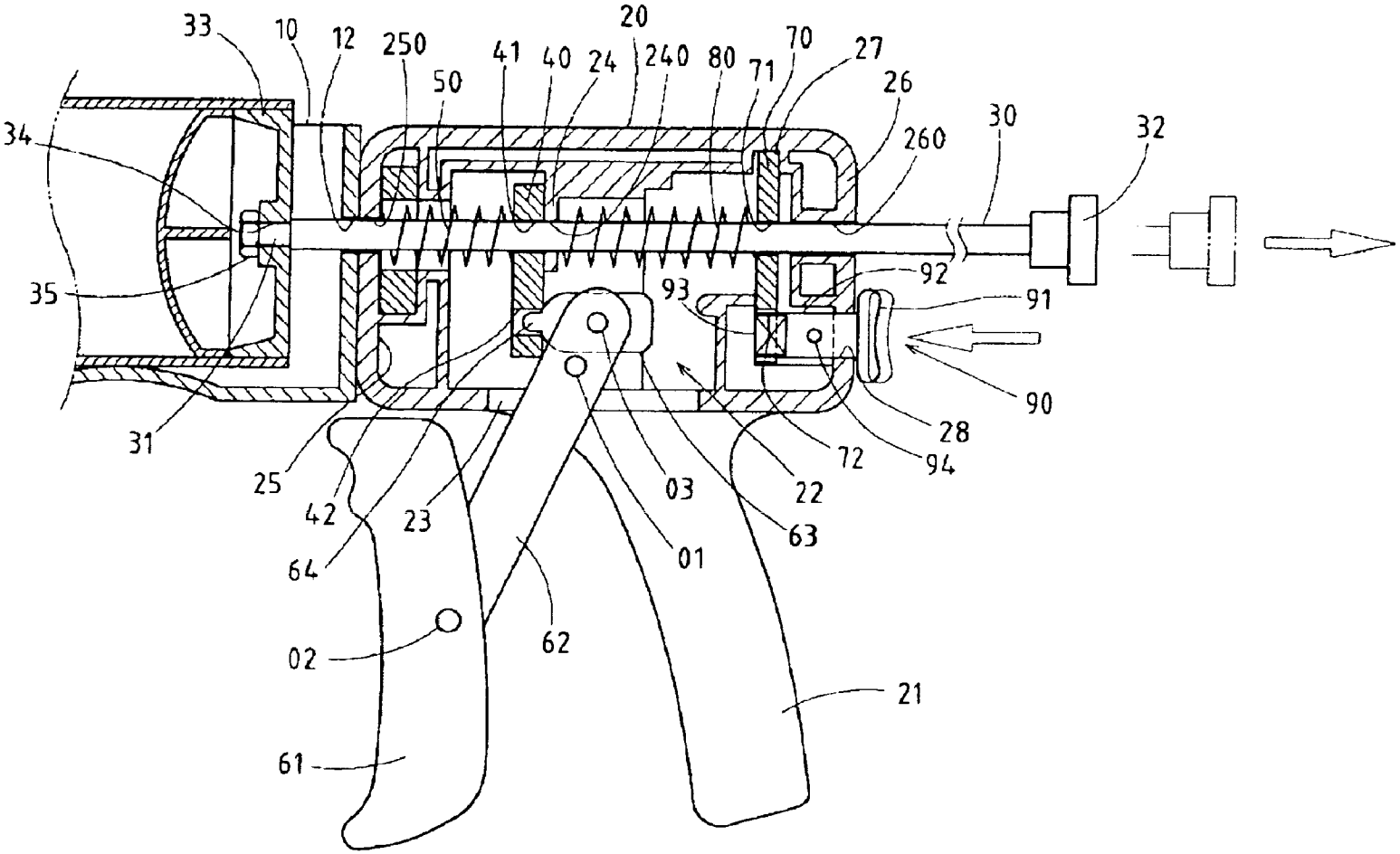
FIG. 3 shows a sectional schematic view of the present invention with the control lever being deactivated.

As shown in FIGS. 1–3, a glue gun of the present invention comprises a receptacle 10, and a main body 20. The receptacle 10 is used to accommodate a glue container 05 which is provided with a glue discharging end 06. The receptacle 10 is provided at one end with a cut 11 for locating the glue discharging end 06, and at the other end with a through hole 12.

The main body 20 comprises a triggering mechanism which is formed of an activation rod 30, a pushing piece 40, a control lever member 60, and a retaining piece 70.

The activation rod 30 has a threaded end 31 and a press end 32. The activation rod 30 is put through the main body 20 such that the threaded end 31 is engaged with a nut 35 via a center through hole 34 of a glue pusher 33 and the through hole 12 of the receptacle 10. The glue pusher 33 is disposed in one end of the glue container 05 for pushing the glue contained in the glue container 05 at such time when the activation rod 30 is activated. The activation rod 30 is disposed in the through hole 250 of a front end 25 of the main body 20, and in the through hole 250 of a rear end 26 of the main body 20. The pushing piece 40 is provided with a through hole 41 and a locating slot 42. The activation rod 30 is put through the through hole 41 of the pushing piece 40, with a spring 50 being fitted over the activation rod 30 such that the spring 50 urges at one end the inner wall of the front end 25 of the main body 20, and that the spring 50 urges at the other end the pushing piece 40. The locating slot 42 of the pushing piece 40 is used to locate a projection 64 of an action piece 63 which is pivoted in a receiving slot 22 of the main body 20 with a connection piece 62 by a pivot 03. The connection piece 62 is pivoted with the main body 20 by a pivot 01. A control lever 61 is pivoted with the connection piece 62 by a pivot 02.

The retaining piece 70 has a through hole 71 and a cut 72. The activation rod 30 is put through the through hole 71 in conjunction with a recovery spring 80 which is fitted over the activation rod 30 such that one end of the spring 80 urges a stop piece 24 of the main body 20, and that the other end of the spring 80 urges the retaining piece 70. The cut 72 is used to retain one end 93 of a release knob 90 which is put through a through hole 28 of the rear end of the main body 20 such that a press end 91 of the release knob 90 is extended out of the main body 20. The main body 20 has a grip 21.

In operation, the control lever 61 is triggered to actuate the action piece 63 through the connection piece 62, thereby causing the action piece 63 to push the lower end of the pushing piece 40. As a result, the activation rod 30 is pushed to move in the direction toward the glue container 05, thereby causing the glue pusher 33 to push the glue out of the glue discharging end 06 of the glue container 05. The glue discharge is interrupted by pressing the release knob 90 to cause the retaining piece 70 to free the activation rod 30, which is thus forced by the spring force of the recovery spring 80 to move in the direction away from the glue container 05.

The embodiment of the present invention described above is to be regarded in all respects as being illustrative and nonrestrictive. Accordingly, the present invention maybe embodied in other specific forms without deviating from the spirit thereof. The present invention is therefore to be limited only by the scope of the following claims.

I claim:

1. A glue gun comprising:

a receptacle for holding a glue container;

a main body fastened at one end to one end of said receptacle and provided in an interior with a receiving slot; and a triggering mechanism disposed in said receiving slot of said main body to activate dispensing of glue contained in the glue container;

wherein said triggering mechanism comprises:

an activation rod movably disposed in said receiving slot of said main body and provided at one end with a glue pusher in contact with the glue held in the glue container;

a push piece fastened to said activation rod in conjunction with a spring fitted over said activation rod;

a control lever member pivoted with said main body such that one end of said control lever member activates said push piece to actuate said activation rod to move in a direction toward the glue container;

a retaining piece pivoted with said activation rod in conjunction with a recovery spring urging at one end of said retaining piece; and a release knob pivoted with said main body such that one end of said release knob is engaged with said retaining piece, and such that said release knob is activated to cause said retaining piece to free said activation rod, thereby enabling said activation rod to move in a direction away from the glue container.

2. A glue gun as defined in claim 1, wherein said control lever member is comprised of a lever, a connection piece pivoted with said lever, and an action piece pivoted with said connection piece such that one end of said action piece comes in contact with said push piece.

* * * * *